United States Patent [19]

Peterson

[11] 4,401,043

[45] Aug. 30, 1983

[54] DOUBLE POINTED LOOPER ACTUATING MECHANISM FOR CHAIN STITCH SEWING MACHINE

[75] Inventor: Wesley R. Peterson, Bound Brook, N.J.

[73] Assignee: The Singer Company, Stamford, Conn.

[21] Appl. No.: 410,672

[22] Filed: Aug. 23, 1982

[51] Int. Cl.[3] ..... D05B 1/06; D05B 3/14

[52] U.S. Cl. ..... 112/199; 112/169; 112/112

[58] Field of Search ..... 112/199, 197, 200, 202, 112/169, 166, 112, 110

[56] References Cited

U.S. PATENT DOCUMENTS 2,410,679 11/1946 Pikul ..... 112/159

3,165,080 1/1965 Castelletti ..... 112/169 X

*Primary Examiner*—H. Hampton Hunter

*Attorney, Agent, or Firm*—William V. Ebs; Robert E. Smith; Edward L. Bell

[57] ABSTRACT

A sewing machine is provided with a double pointed looper and actuating mechanism therefore including a double tracked cam, an actuator operable on the cam tracks, and a gate with a resiliently movable portion for controlling movement of the actuator between the cam tracks.

9 Claims, 17 Drawing Figures

DOUBLE POINTED LOOPER ACTUATING MECHANISM FOR CHAIN STITCH SEWING MACHINE

BACKGROUND OF THE INVENTION

1. Field of the Invention

The invention relates to chain stitch sewing machines and more particularly to actuating mechanisms for double pointed loopers in such machines.

2. Description of the Prior Art

Single thread chain stitch sewing machines utilizing double pointed loopers are commonly used in machines for sewing buttons onto garments and sewing a series of substantially superimposed stitches for tacking together multiple pieces of material. Various means have been utilized in such machines for driving the double pointed loopers so as to alternately place each of the two loops seizing points into cooperative association with a sewing needle as required to provide for the formation of chain stitches. However, the looper actuating mechanisms employed heretofore have generally been structurally complex as well as costly to produce, and have frequently failed in use.

It is a prime object of the present invention to provide a double pointed looper in a sewing machine with improved actuating mechanism which is simple in construction, has few parts, and is inexpensive to manufacture as well as maintain.

It is another object of the invention to provide a double pointed looper in a sewing machine with improved actuating mechanism as described which is reliable in operation.

Other objects and advantages of the invention will become apparent hereinafter during a reading of the specification taken in connection with the accompanying drawings.

SUMMARY OF THE INVENTION

A chain stitch sewing machine including a double pointed looper is provided with camming means including two intersecting cam tracks and an actuator to slidingly engage the tracks alternately and move the looper so as to place each of the two loop seizing points alternately in cooperative engagement with the needle as required to provide for the formation of chain stitches on the machine. A gate movable with respect to the cam tracks includes a part which extends between the tracks at their intersection. The actuator while in each track moves the gate from a held position wherein the entrance to the track with the actuator therein is open and the entrance in the other track is closed by the extending gate part, to another held position wherein the entrance to the track with the actuator therein is closed by the extending gate part and the entrance to the other track is open. The extending gate part is resiliently movable with respect to another part of the gate and the actuator can exit from each track by temporarily moving the extending gate part from its position closing the entrance thereto.

DESCRIPTION OF THE INVENTION

Figure 2:
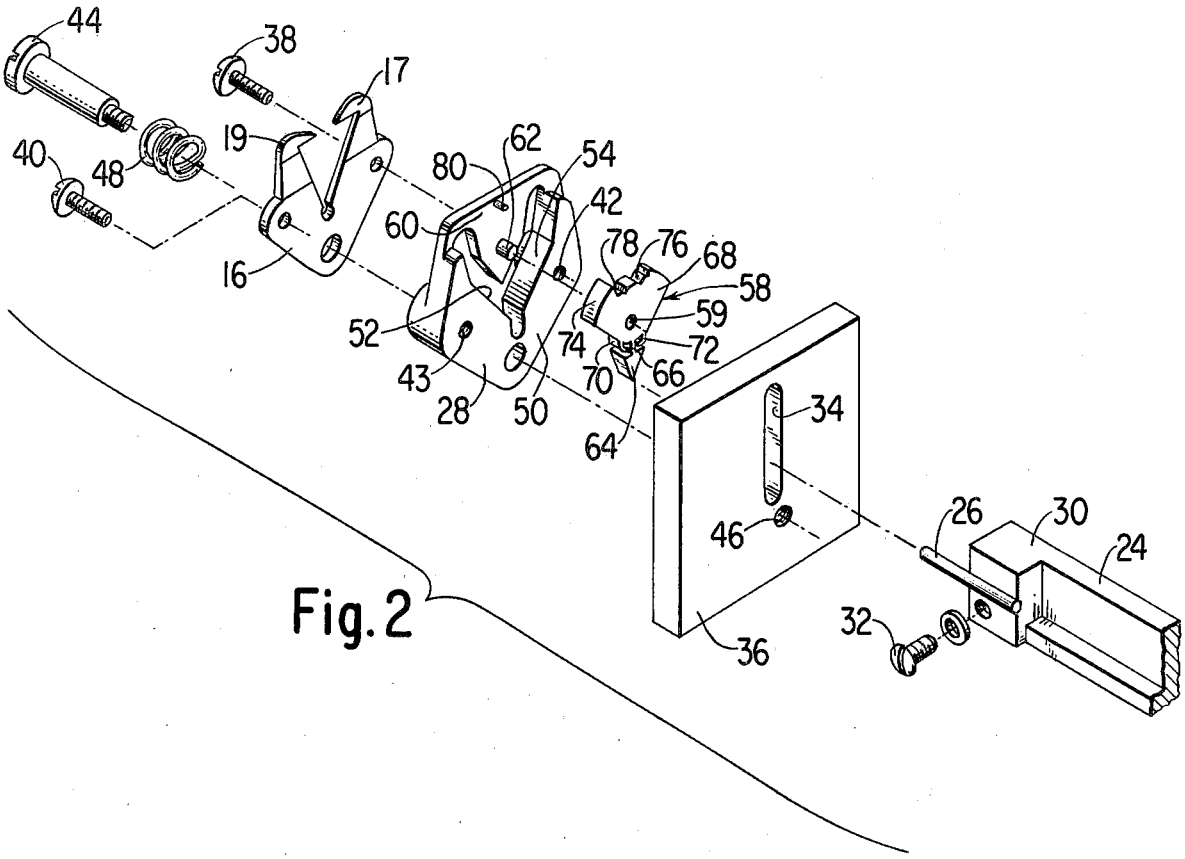
FIG. 2 is an exploded perspective view showing the looper mechanism.
Figure 1:
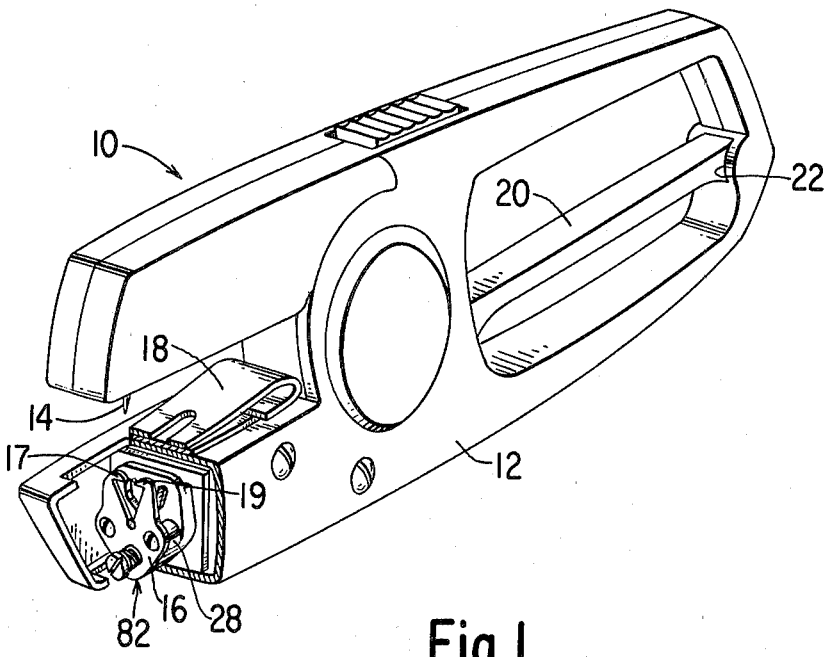
FIG. 1 is a perspective view of a sewing machine incorporating looper controlling mechanism according to the invention.
Figure 4:
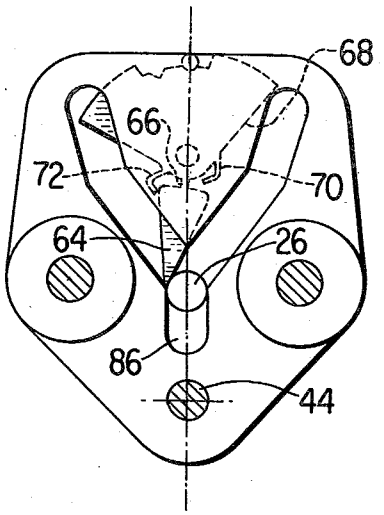
FIGS. 3, 4, 5, 6, 7, 8 and 9 are end views of the looper controlling mechanism shown in various operating positions.

Referring to FIGS. 1 through 11, there is shown a hand held sewing machine 10 including a frame 12, a thread carrying needle 14 arranged for reciprocating movement and a pivotally movable looper 16 with opposing loop seizing points 17 and 19 which cooperate with the needle in the formation of chain stitches. A work piece feed mechanism 18 is arranged to undergo movements in cooperation with those of the needle 14 and the looper 16 in a well known manner, to properly position the work piece. A hand operated lever 20 which is pivotally attached at one end 22 to the frame 12 is interconnected with the needle 14 and feed mechanism 18 to impart the desired movements thereto. Such interconnections are well known in the sewing machine art and therefore shall not be detailed here.

The hand operated lever 20 acting through a drive arm 24, an actuator in the form of a drive pin 26 on the arm, and a pivoted cam 28 driven by the actuator as hereinafter described also imparts movement to the looper 16. As shown, the drive pin 26 is held in place on the free end portion 30 of arm 24 by a suitable fastener 32, and extends through an elongated hole 34 in a guide block 36 which is rigidly attached to the frame 12, the elongated hole being arranged to slidingly receive drive pin 26 for the guiding thereof in a vertical plane. The drive pin further extends beyond the guide block to the cam 28 to provide for the actuation of the cam and thereby the looper 16 which is affixed to the cam with screw fasteners 38 and 40 that are threaded into holes 42 and 43 respectively in the cam.

Cam 28 with attached looper 16 (designated in the drawings as assembly 82) is pivotally attached to the guide block 36 with a screw fastener 44 which is threaded into a hole 46 formed in the guide block. A helical compression spring 48 disposed between the head of the screw fastener 44 and the looper 16 urges the cam and looper toward the guide block so that the surface 50 of the cam is maintained in sliding engagement with the guide block. The cam includes two cam tracks 52 and 54 which intersect at their lower extremities and receive an end portion of the drive pin 26 extending through elongate hole 34 in block 36. Pin 26 which is vertically reciprocated by operation of handle 20 moves along the tracks to impart reciprocatory motion to the cam.

A gate 58 is pivotally mounted at 59 in a recessed portion 60 of the cam on a fixed pin 62. The gate is a molded plastic member including a triangularly shaped depending part 64 which extends between the tracks 52 and 54 at their intersection. Depending part 64 connects through a thin flexible section 66 with another part 68 including springy appendages 70 and 72 that serve to resiliently resist movement of the depending gate part 64 relative to part 68. Gate part 68 is formed along a curved edge 74 with spaced apart notches 76 and 78 wherein a resilient pin 80 affixed in the gate is receivable.

Figure 3:
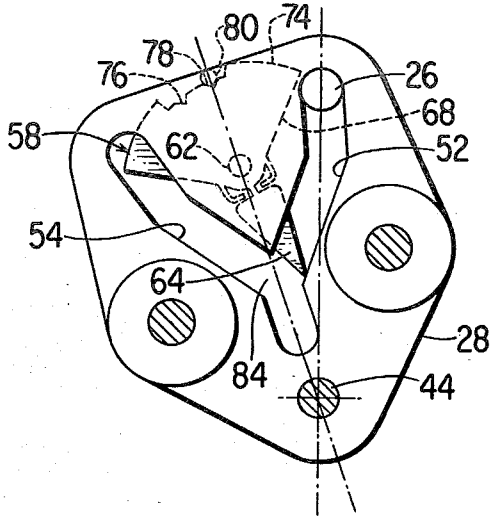

FIGS. 3 through 9 inclusive illustrate the operation of cam 28, gate 58 and looper 16 in response to vertical movement of the drive pin 26. In FIG. 3 drive pin 26 may be seen at one end of its excursion in the upper end of track 52. The cam 28 and attached looper 16 are then cocked to the left with respect to the path of travel of pin 26, and the gate 58 is latched by resilient pin 80 in notch 78 in a position wherein depending gate port 64 extends across the lower end of the track 52 at the intersection of track 52 with track 54.

Figure 5:
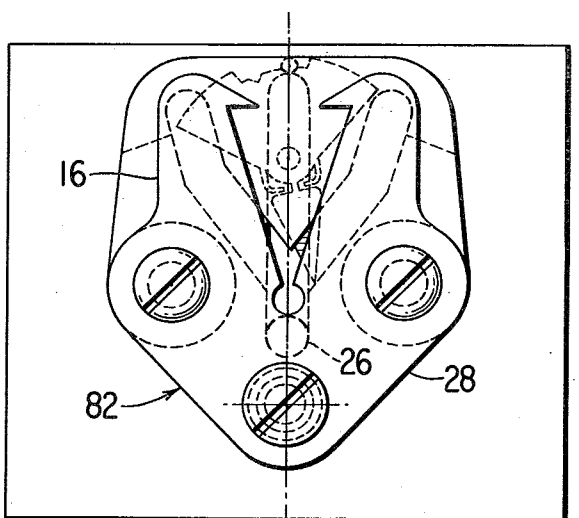
Figure 7:
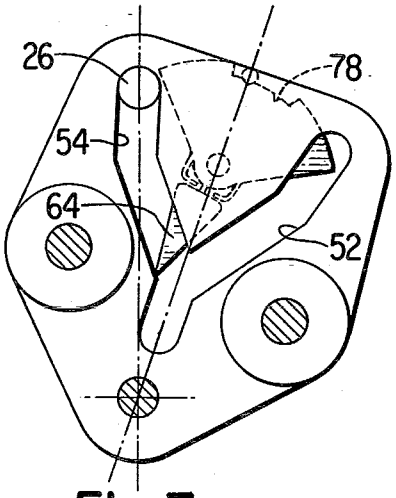

Pin 26 moves downwardly from its upper end position, and as it slides along the cam track 52 imparts clockwise movement to the cam and looper assembly 82 about screw 44. The pin moves gate part 64 aside against the bias of spring appendage 72 to enter the track intersecting region 84 (FIG. 4), and then passes into the lower extremity 86 of region 84 whereupon the gate part 64 is returned by spring appendage 72 to its position across the lower end of track 52 so as to block the entrance to track 52 and unblock the entrance to track 54 (FIG. 5).

Figure 6:
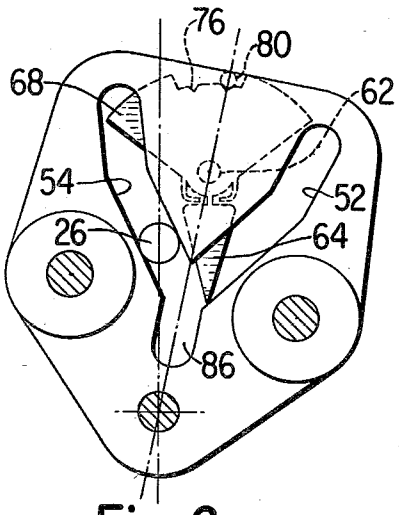
Figure 8:
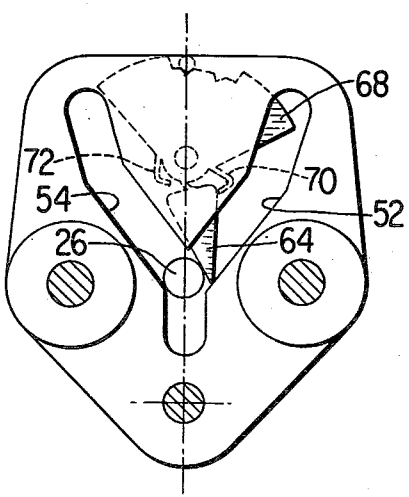
Figure 10:
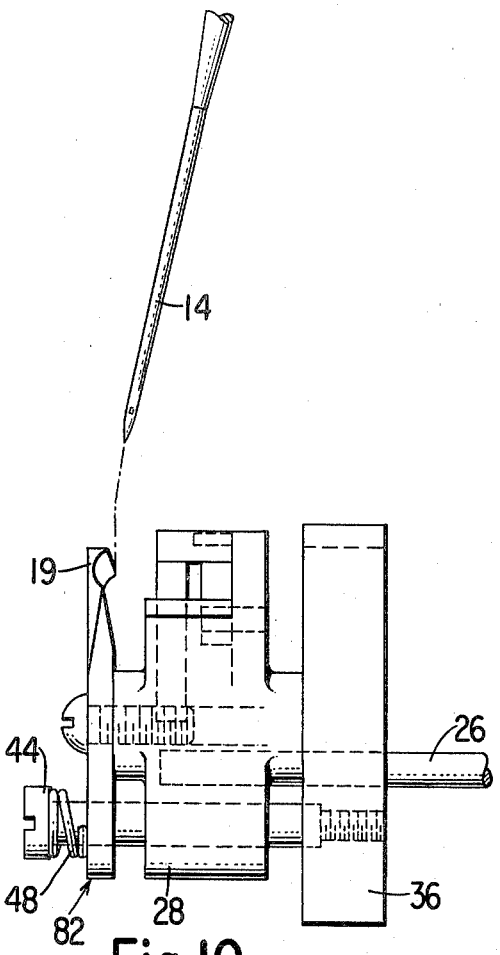
FIG. 10 is a side view showing a needle approaching the looper.
Figure 11:
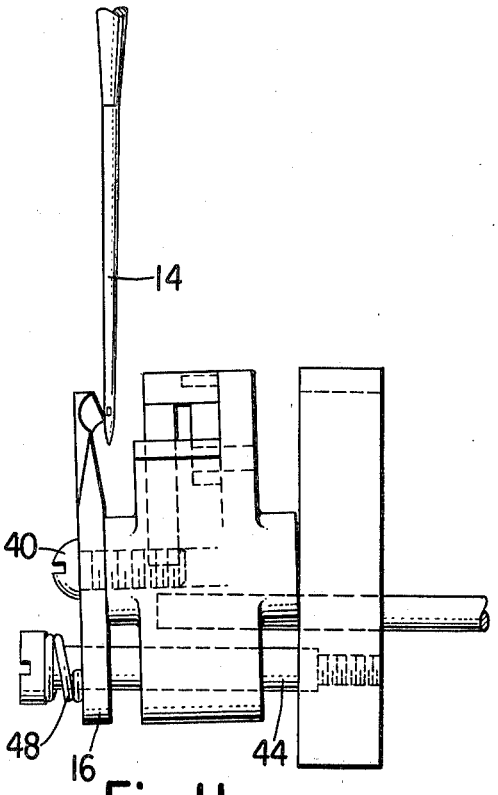
FIG. 11 is similar to FIG. 10 but showing the needle and looper in engagement.

Pin 26 moves upwardly from a lower end position in the lower extremity 86 of track intersecting region 84 and enters unblocked track 54 (FIG. 6). The pin moves toward the upper end of track 54 and causes the cam and looper assembly 82 to be moved in a clockwise direction. In addition, the pin by engaging the gate part 68 in track 54 causes the gate 58 to be moved in a clockwise direction about pivot pin 62 from the latched position with pin 80 in notch 78 to a position wherein pin 80 is caused to enter notch 76 and depending gate part 64 is caused to extend across the lower end of track 54 (FIG. 7) instead of track 52.

Figure 9:
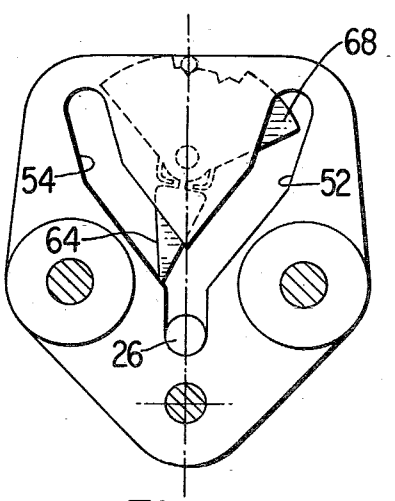

The drive pin 26 moves downwardly from an upper end position in the upper end of track 54 causing assembly 82 to be moved in a counterclockwise direction, and at the bottom of the track the pin pushes depending portion 64 of gate 58 aside against the bias of spring appendage 70 to enter the intersection between the tracks (FIG. 8) and then pass into the lower extremity thereof, after which gate part 64 is returned to its position across the lower end of track 54 so as to block the entrance to such track and to unblock the entrance to track 52 (FIG. 9).

The drive pin moves upwardly from the intersecting track region into track 52 and then along track 52 wherein the pin is effective to urge assembly 82 further in a counterclockwise direction and wherein the pin comes into engagement with cam 58 causing it to be moved back to the position wherein latch pin 80 registers in notch 78 and depending gate part 64 extends across the lower end of track 52. After pin 26 reaches the upper end of track 52 (FIG. 3) the described operational cycle of the cam and looper assembly 82 is repeated in response to continued vertical reciprocation of the pin.

Figure 12:
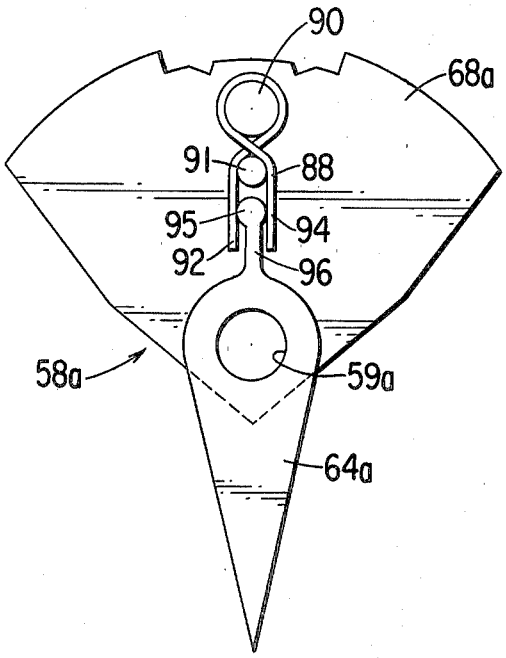
FIG. 12 is an enlarged end view, partially in section, showing a modified gate construction for the looper mechanism.

The gate may be variously constructed so as to include a depending part resiliently movable relative to another part which is engageable by a drive pin in the cam tracks 52 and 54. Examples of different constructions may be seen in FIGS. 12 through 17 wherein parts generally similar to those on gate 58 are designated with corresponding reference characters having a subscript added thereto. In the gate **58*a* shown in FIG. 12, the depending gate part 64*a* is a separate member which pivotally mounts at 59*a* on the cam affixed pin 62 along with the other part 68*a* of the gate engageable in the cam tracks 52 and 54 by the drive pin 26. A spring 88 extending around a fixed pin 90 on gate part 68*a* and over another fixed pin 91 thereon has free end portions 92 and 94 in engagement with a bulb 95 at the end of a flanged extension 96 on the said gate part 64*a*. The spring biases gate part 68*a* toward a centralized position on gate part 64*a*, but permits gate part 68*a* to be moved relative to gate part 64*a* by drive pin 26** when exiting from a cam track.

Figure 13:
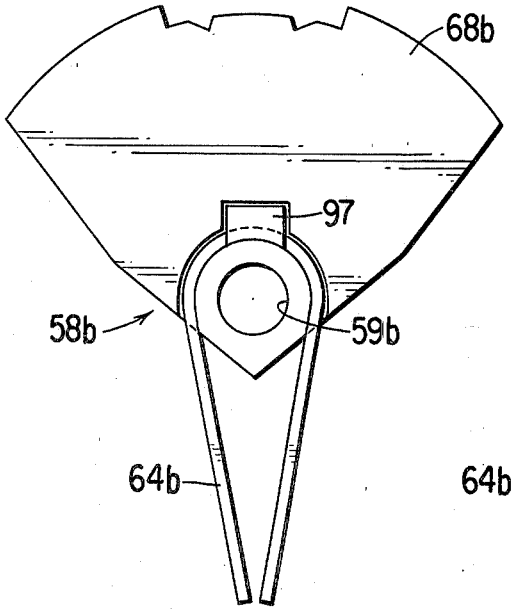
FIGS. 13 and 14 are enlarged end and side views respectively showing another modified gate construction.
Figure 14:
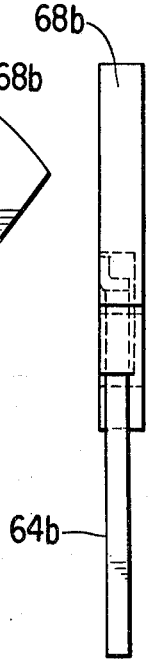

In the gate **58*b* shown in FIGS. 13 and 14, the depending gate part 64*b* is keyed at 97 to gate part 68*b* which pivotally mounts at 59*b* on the cam affixed pin 62. Gate part 64*b* is formed of a resilient sheet material such as sheet steel and has free ended legs which can be flexed from a normal position, as illustrated, by the drive pin 26** when exiting from a cam track and which will return to such normal position after passage of the pin.

Figure 15:
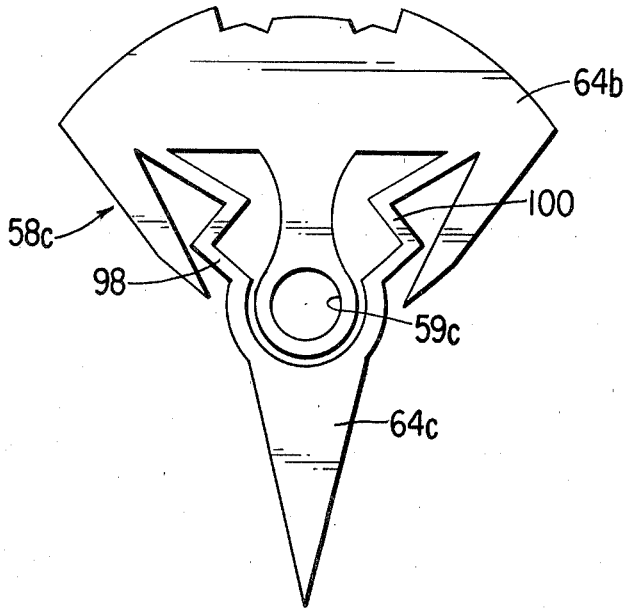
FIG. 15 is an enlarged end view showing still another modified gate construction.

FIG. 15 shows a one-piece molded plastic gate **58*c* with a depending part 64*c* which connects with the other part 64*b* of the gate through resiliently foldable, thin zig-zag sections 98 and 100 that serve as centering springs for part 64*c***.

Figure 16:
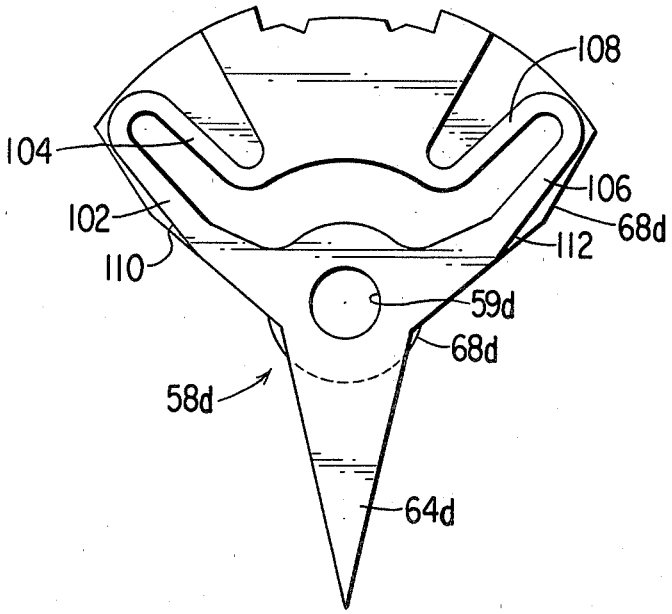
FIGS. 16 and 17 are enlarged end and side views respectively showing yet another modified gate construction.
Figure 17:
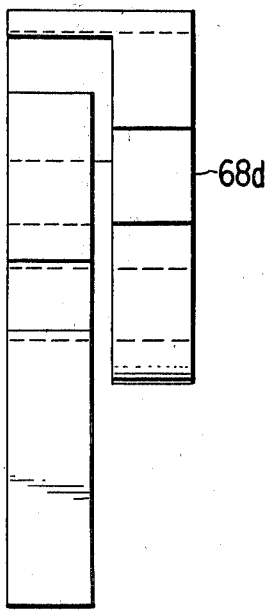

In FIGS. 16 and 17 there is shown a one piece molded plastic gate **58*d* on which a front depending part 64*d* connects with a rear part 68*d* through thin, resilient walls 102, 104, 106 and 108 formed in the gate in the plane of depending part 64*d*. The thin walls 102, 104, 106 and 108 normally maintain the depending part 64*d* in a centralized position on the gate and return part 64*d* to such position after removal therefrom. The entire gate 58*d* is pivoted by engagement with drive pin 26 along side edges 110 and 112 on gate part 68*d***.

It is to be understood that the present disclosure relates to preferred embodiment of the invention which are for purposes of illustration only and are not to be construed as limiting the invention. Numerous alterations and modifications of the structure herein will suggest themselves to those skilled in the art, and all such modifications, and alterations which do not depart from the spirit and scope of the invention are intended to be included within the scope of the appended claims.

I claim:

1. In a sewing machine; a frame; a sewing needle reciprocable in the frame; a looper with two loop seizing points; camming means affixed to the looper and including two intersecting cam tracks; an actuator to slidingly engage the cam tracks alternately and effect motion of the looper alternately placing each of the two loop seizing points in cooperative engagement with the needle for the formation of chain stitches; a gate movable with respect to the cam tracks and including a part which extends between the tracks at the intersection thereof, said gate during movement of the actuator in each track being movable by the actuator from a held position wherein the entrance to the track with the actuator therein is open and the entrance to the other track is closed by the extending gate part, to another held position wherein the entrance to the track with the actuator therein is closed by the extending gate part and the entrance to the other track is open, said extending gate part being resiliently movable with respect to another part of the gate to thereby enable the actuator to exit from each track by temporarily moving the said extending gate part from its position closing the entrance thereto.

2. The combination of claim 1 wherein the gate is positioned by engagement with the cam actuator.

3. The combination of claim 1 including means for resiliently retaining the gate in the said held positions between movements therebetween.

4. The combination of claim 1 wherein the gate is pivotally mounted on the cam.

5. The combination of claim 1 wherein the gate is an integrally molded plastic unit which includes a thin flexible section between the extending part and said another part, and spring means between the gate parts bias the extending gate part toward a defined position on the gate.

6. The combination of claim 5 wherein the spring means comprises plastic molded portions of the said another part of the gate.

7. The combination of claim 1 wherein the extending gate part is pivotally movable with respect to said another gate part and is biased toward a defined position on the gate by spring means.

8. The combination of claim 1 wherein the extending gate part is a resiliently deformable member.

9. The combination of claim 1 wherein the gate is an integrally molded plastic unit which includes foldable resilient portions that bias the extending gate part toward a defined position on the gate.

* * * * *